US007217093B2

(12) United States Patent
Propheter et al.

(10) Patent No.: US 7,217,093 B2
(45) Date of Patent: May 15, 2007

(54) ROTOR BLADE WITH A STICK DAMPER

(75) Inventors: Tracy A. Propheter, Manchester, CT (US); Raymond C. Surace, Newington, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/855,184

(22) Filed: May 27, 2004

(65) Prior Publication Data

US 2005/0265843 A1 Dec. 1, 2005

(51) Int. Cl.
*F01D 5/26* (2006.01)

(52) U.S. Cl. ..... 416/97 R; 416/96 A; 416/500

(58) Field of Classification Search ..... 416/97 R, 416/96 R, 500, 244, 96 A
See application file for complete search history.

(56) References Cited

U.S. PATENT DOCUMENTS 2,689,107 A * 9/1954 Odegaard ..... 416/233
4,437,810 A * 3/1984 Pearce ..... 415/115
5,407,321 A * 4/1995 Rimkunas et al. ..... 415/119
5,558,497 A 9/1996 Kraft et al. ..... 416/96
5,820,343 A 10/1998 Kraft et al. ..... 416/96
6,283,707 B1 * 9/2001 Chin ..... 416/96 A
6,929,451 B2 * 8/2005 Gregg et al. ..... 416/96 R

FOREIGN PATENT DOCUMENTS

GB 347964 A 5/1931

OTHER PUBLICATIONS

Pending patent application for U.S. Appl. No. 10/771,587.

* cited by examiner

*Primary Examiner*—Edward K. Look
*Assistant Examiner*—Nathan Wiehe
(74) *Attorney, Agent, or Firm*—McCormick, Paulding & Huber LLP

(57) ABSTRACT

A rotor blade damper is provided that includes a body having a base, a tip, a first contact surface, a second contact surface, a trailing edge surface, and a leading edge surface. The trailing edge and the leading edge surfaces extend between the contact surfaces. The first contact surface, second contact surface, trailing edge surface, and leading edge surface all extend lengthwise between the base and the tip. The body includes at least one cooling aperture disposed adjacent the base, that has a diameter that is approximately equal to or greater than the width of the trailing edge surface adjacent the tip. The body tapers between the base and the tip such that a first widthwise cross-sectional area adjacent the base is greater than a second widthwise cross-sectional area adjacent the tip.

14 Claims, 4 Drawing Sheets

FIG.1
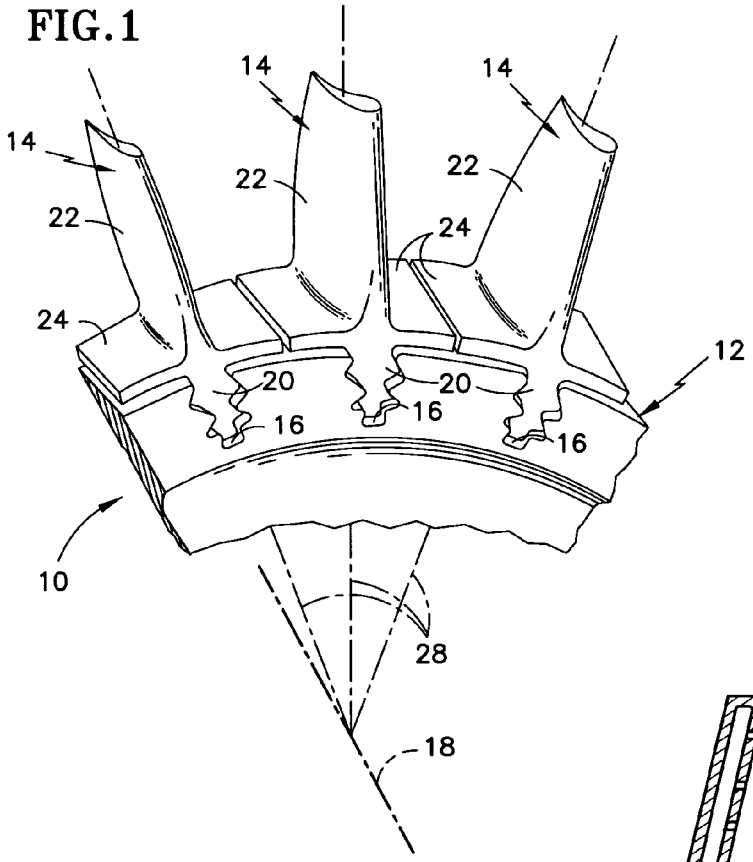
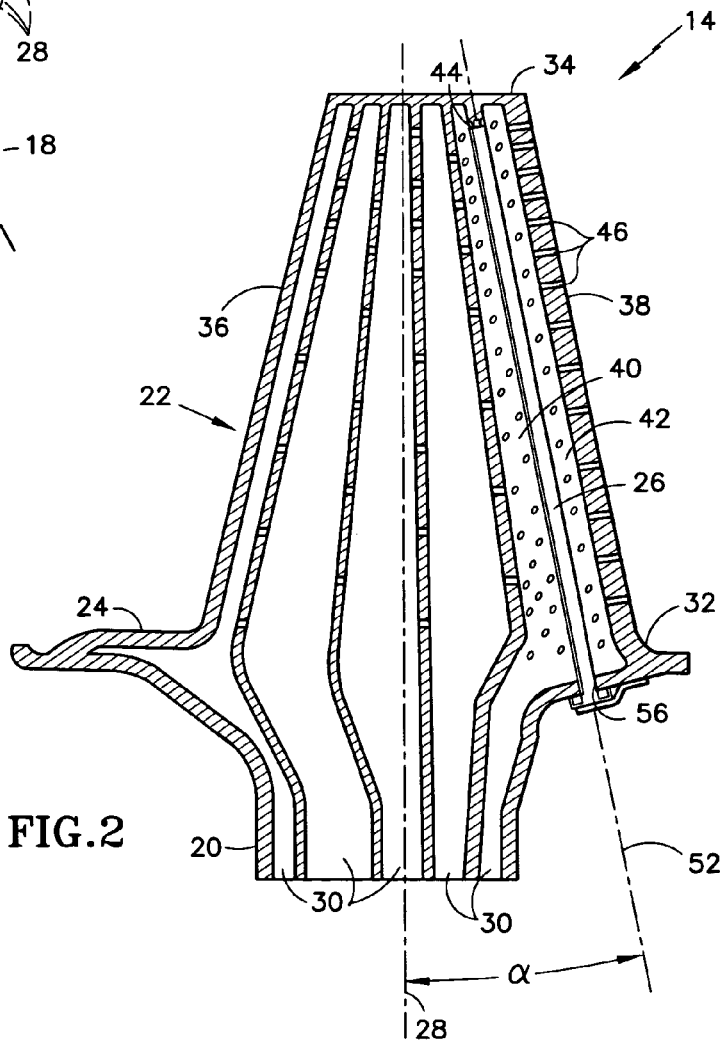
FIG.2

ROTOR BLADE WITH A STICK DAMPER

The invention was made under a U.S. Government contract and the Government has rights herein.

BACKGROUND OF THE INVENTION

1. Technical Field

This invention applies to rotor blades in general, and to apparatus for damping vibration within a rotor blade in particular.

2. Background Information

Turbine and compressor sections within an axial flow turbine engine generally include a rotor assembly comprising a rotating disc and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage. The forward edge of each blade is generally referred to as the leading edge and the aft edge as the trailing edge. Forward is defined as being upstream of aft in the gas flow through the engine.

During operation, blades may be excited into vibration by a number of different forcing functions. Variations in gas temperature, pressure, and/or density, for example, can excite vibrations throughout the rotor assembly, especially within the blade airfoils. Gas exiting upstream turbine and/or compressor sections in a periodic, or "pulsating", manner can also excite undesirable vibrations. Left unchecked, vibration can cause blades to fatigue prematurely and consequently decrease the life cycle of the blades.

It is known that friction between a damper and a blade may be used as a means to damp vibrational motion of a blade. How much vibrational motion may be damped depends upon the magnitude of the frictional force between two surfaces. The frictional force is a function of the amount of surface area in contact between the two surfaces, the frictional coefficients of the two surfaces, and the normal force keeping the surfaces in contact with each other. If the spring rate of the damper (i.e., the normal force) decreases because of fatigue in the spring and/or the thermal environment, the amount of vibrational motion that may be damped similarly decreases. If the surface against which the damper acts decreases in area or wears away from the damper, the effectiveness of the damper is also negatively effected.

In addition to the damping requirements, dampers must also be able to perform and last in a very high temperature environment. In some applications it is possible to cool the damper to enhance its durability within the high-temperature environment For example, it is known to cool a stick damper by disposing cooling holes along the radially extending length of the damper. It is also known to dispose slots within the contact surfaces of a damper spaced along the entire length of the damper. Features that enhance heat transfer such as cooling apertures and slots create stress concentration factors ("KT") that negatively affect the durability of the damper.

In short, what is needed is a rotor blade having a vibration damping device that is effective in damping vibrations within the blade, one that can be effectively cooled, and one that provides desirable durability.

DISCLOSURE OF THE INVENTION

According to the present invention, a rotor blade damper is provided. The damper includes a body having a base, a tip, a first contact surface, a second contact surface, a trailing edge surface, and a leading edge surface. The trailing edge and the leading edge surfaces extend between the contact surfaces. The first contact surface, second contact surface, trailing edge surface, and leading edge surface all extend lengthwise between the base and the tip. The body includes at least one cooling aperture disposed adjacent the base, that has a diameter that is approximately equal to or greater than the width of the trailing edge surface adjacent the tip. The body tapers between the base and the tip such that a first widthwise cross-sectional area adjacent the base is greater than a second widthwise cross-sectional area adjacent the tip.

According to an aspect of the present invention, a rotor blade is provided having a passage, and the above-described rotor blade damper is disposed within the damper.

According to an embodiment of the present invention, the body includes at least one cooling channel disposed in each contact surface adjacent the tip.

An advantage of the present invention is that the present invention damper permits the rotor blade to have a desirable narrow thickness adjacent the tip of the blade. The present damper is tapered, decreasing in cross-sectional area between the base and the tip. The tip end of the damper is sized so that it may be disposed within a narrow tip region of a rotor blade. The thickness of many prior art dampers prohibits the use of a damper within a rotor blade having a narrow tip region. Durability requirements required prior art damper designs to be relatively "thick" at the tip end. Durability is a function of the thermal environment and stress to which the damper is exposed. The present invention provides enhanced cooling and decreased stress relative to prior art dampers of which we are aware. As a result, it is possible to use a damper having a narrow tip, within a rotor blade having a narrow thickness adjacent the tip.

The effectiveness of the present tapered damper is a result of the stiff, larger cross-sectional area base and the smaller cross-sectional area tip. The stiff base provides desirable frictional contact under load, while the relatively narrow tip permits greater centrifugal loading between the damper and the blade in a blade area subject to high cycle fatigue.

The tapered body of the damper is subjected to less stress than would be a damper having a body with a constant cross-section. The taper reduces the mass of the damper increasingly in the direction from the base to the tip. Consequently, stress that is attributable to mass located at the radial end of the damper (i.e., the tip) is reduced.

The tapered body of damper also facilitates cooling of the damper and adjacent airfoil along the length of the damper without substantially affecting the ability of the damper to provide the desired damping. The greater widthwise cross-sectional area adjacent the base end of the damper permits cooling apertures disposed within the damper extending between the leading edge and trailing edge surfaces of the damper. The diameter of the cooling holes is large enough to accommodate most debris encountered within the turbine blade, and thereby prevent blockage. The cooling channels disposed adjacent the second end of the body permit cooling of the second end of the damper.

The prior art teaches that cooling channels may be disclosed within the contact surfaces, spaced apart along the length of the damper. In an embodiment of the present invention, cooling channels are disposed within the contact surfaces of the damper adjacent the tip and cooling apertures are disposed within the damper adjacent the base. The cooling apertures disposed within the base region create a stress concentration factor (KT) within the base that is less than the stress concentration factor (KT) typically associated with cooling channels disposed within the contact surfaces of a damper. Consequently, the amount of low cycle fatigue experienced by the damper within the base region is less than that which would be present if cooling channels were used in place of the cooling apertures.

The cooling channels disposed within the contact surfaces of the damper adjacent the tip, provide cooling in a region of the damper where it is not possible to utilize cooling apertures having a diameter the same as or larger than the diameter of the cooling apertures disposed within the base. The diameter of the cooling apertures within the base are approximately equal to or greater than the width of the trailing edge surface adjacent the tip. Consequently, a cooling aperture of the same diameter disposed adjacent the tip would either break through the contact surfaces of the damper, or would leave an unacceptable wall thickness adjacent the trailing edge surface between the aperture and each contact surface. A smaller diameter cooling aperture would be more susceptible to blockage by debris traveling within the cooling air.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a partial perspective view of a rotor assembly.

FIG. 2 is a cross-sectional view of a rotor blade.

BEST MODE FOR CARRYING OUT THE INVENTION

Figure 3:
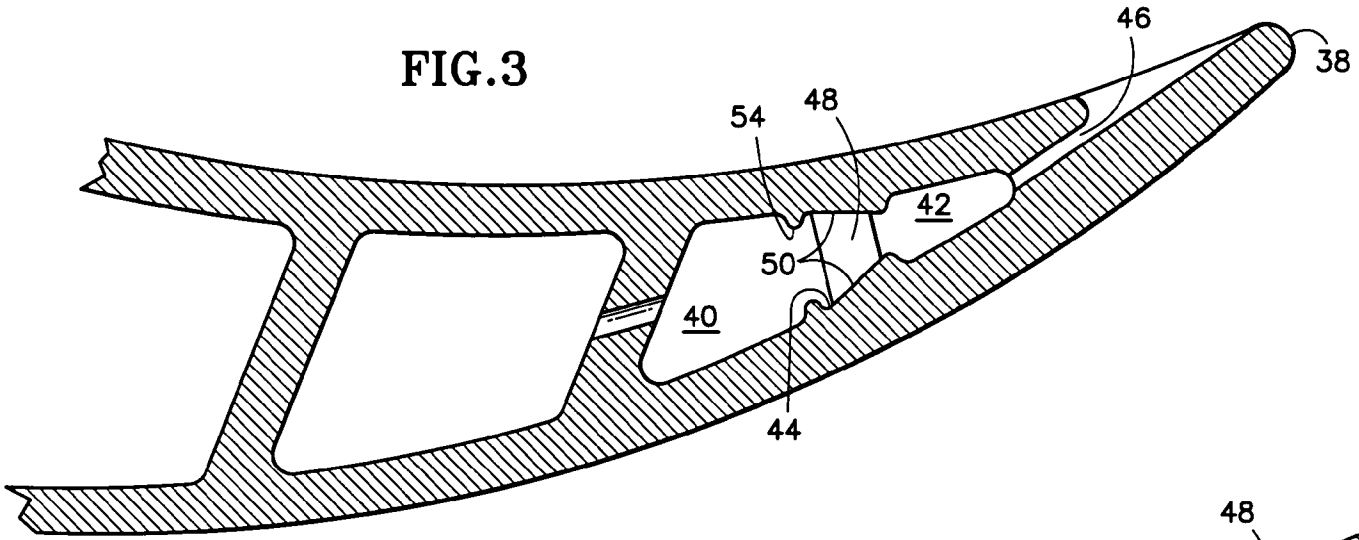
FIG. 3 is a diagrammatic cross-sectional view of a rotor blade section.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 18 about which the disk 12 may rotate. Each blade 14 includes a root 20, an airfoil 22, a platform 24, and a damper 26 (see FIG. 2). Each blade 14 also includes a radial centerline 28 passing through the blade 14, perpendicular to the rotational centerline 18 of the disk 12. The root 20 includes a geometry (e.g., a fir tree configuration) that mates with that of one of the recesses 16 within the disk 12. The root 20 further includes conduits 30 through which cooling air may enter the root 20 and pass through into the airfoil 22.

Referring to FIGS. 2 and 3, the airfoil 22 includes a base 32, a tip 34, a leading edge 36, a trailing edge 38, a first cavity 40, a second cavity 42, and a passage 44 between the first and second cavities 40, 42. The airfoil 22 tapers inward from the base 32 to the tip 34; i.e., the length of a chord drawn at the base 32 is greater than the length of a chord drawn at the tip 34. The first cavity 40 is forward of the second cavity 42 and the second cavity 42 is adjacent the trailing edge 38. The airfoil 22 may include more than two cavities, however. The second cavity 42 contains a plurality of apertures 46 disposed along the trailing edge 38 through which cooling air may pass. In the embodiment shown in FIG. 4, the first and second cavities 40, 42 are formed from a single cavity by the damper 48 disposed therebetween.

The passage 44 between the first and second cavities 40, 42 comprises a pair of walls 50 extending substantially from base 32 to tip 34. One or both walls 50 converge toward the other wall in the direction from the first cavity 40 to the second cavity 42. The centerline 52 of passage 44 is skewed from the radial centerline 28 of the blade 14 by an angle $\alpha$, such that the tip end of the passage 44 is closer to the radial centerline 28 than the base end of the passage 44. A plurality of tabs 54 may be included in the first cavity 40, adjacent the passage 44, to maintain the damper 48 within the passage 44. In the embodiment shown in FIG. 2, an aperture 56 disposed in the platform 24 enables the damper 48 to be inserted into the passage 44.

Figure 4:
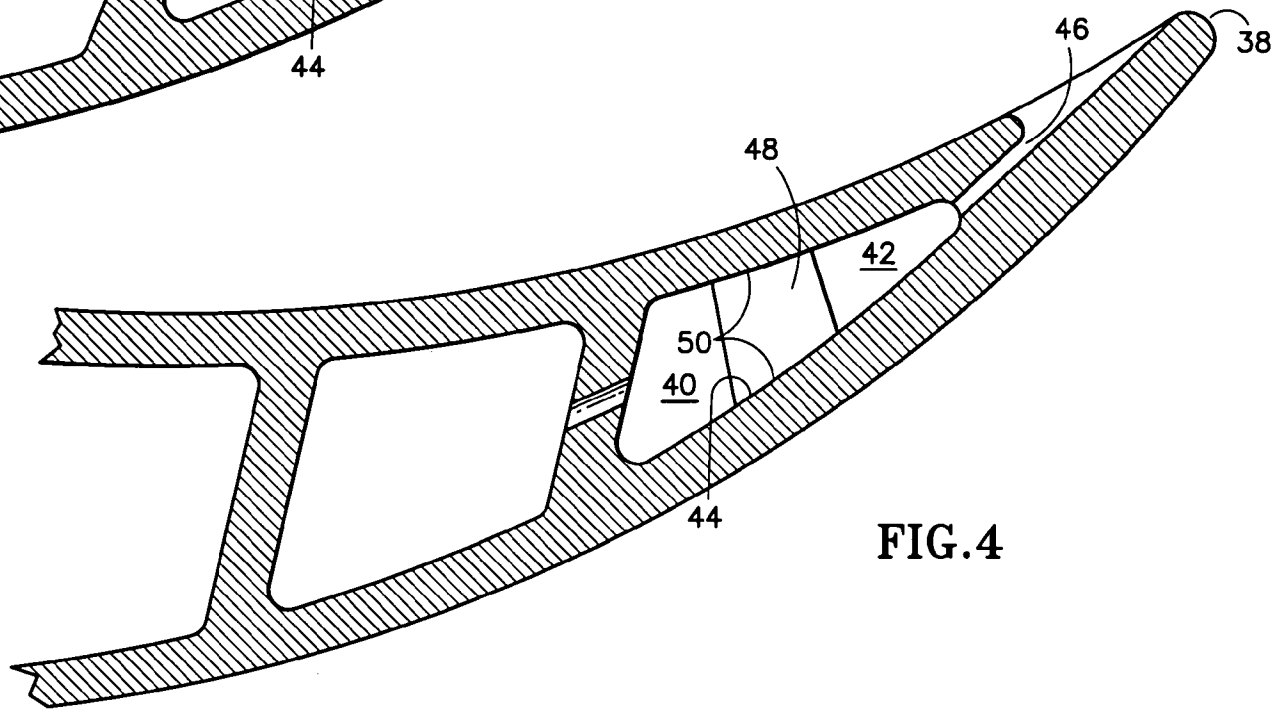
FIG. 4 is a diagrammatic cross-sectional view of a rotor blade section.
Figure 5:
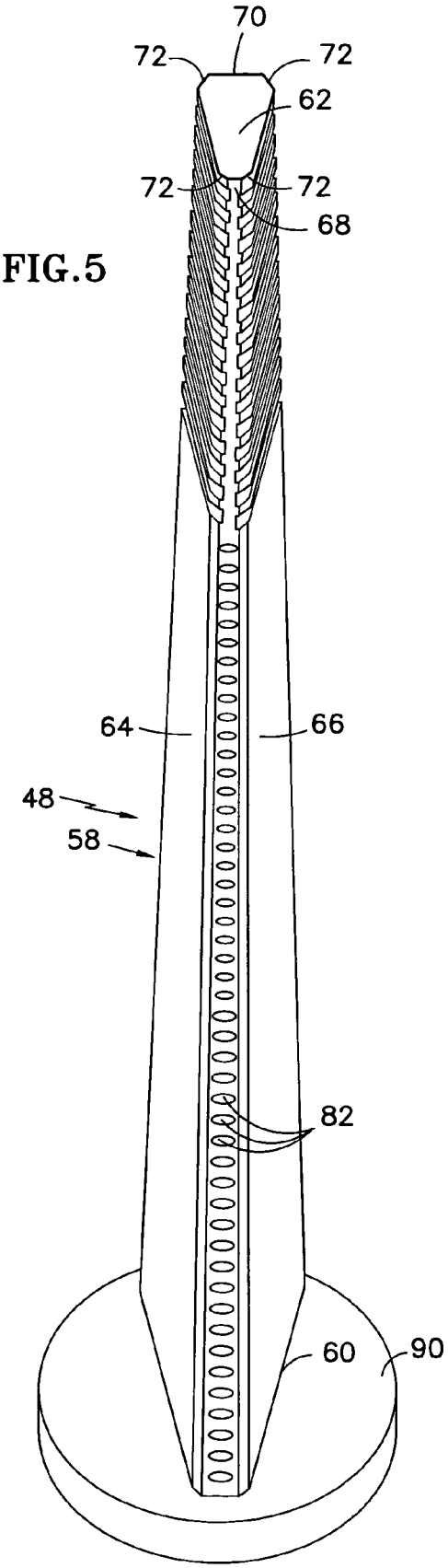
FIG. 5 is a diagrammatic perspective view of an embodiment of the present damper.
Figure 6:
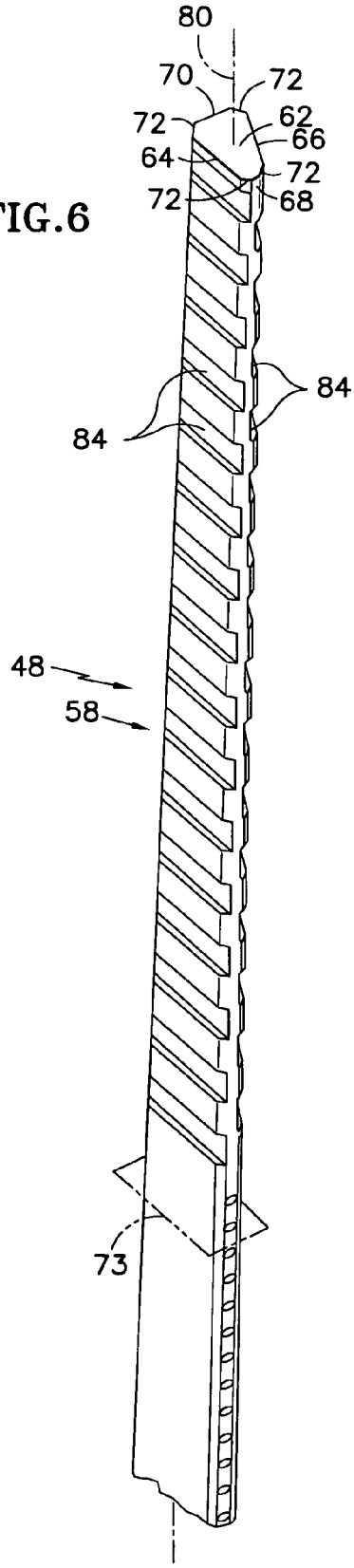
FIG. 6 is a diagrammatic perspective partial view of an embodiment of the present damper.

Referring to FIGS. 5 and 6, the damper 48 includes a body 58 having a base 60, a tip 62, a first contact surface 64, a second contact surface 66, a trailing edge surface 68, and a leading edge surface 70. The trailing edge and the leading edge surfaces 68,70 extend between the contact surfaces 64, 66. The first and second contact surfaces 64, 66, the trailing edge surface 68, and the leading edge surface 70 all extend lengthwise between the base 60 and the tip 62. The contact surfaces 64, 66 may be smooth or textured. In some embodiments, the width of the body 58 at the trailing edge surface 68 is less than the width of the body at the leading edge surface 70. In those embodiments, the body may be described as tapered between the trailing edge surface 68 and the leading edge surface 70. The body 58 may assume different cross-sectional shapes. FIGS. 3 and 4 show a damper 48 having a substantially trapezoidal shape. FIGS. 5 and 6 show a damper 48 having a trapezoidal shape with a relief 72 at each edge. In alternative embodiments, the trailing edge-surface 68 may be arcuately shaped.

The body 58 tapers between the base 60 and the tip 62 such that a first widthwise cross-sectional area adjacent the base 60 is greater than a second widthwise cross-sectional area adjacent the tip 62; i.e., the body 58 decreases in cross-sectional area between the base 60 and the tip 62, in the direction from the base 60 to the tip 62. FIG. 6 shows an example of a plane 73 in phantom. A sectional cut of the body 58 within that plane 73 would be a widthwise cross-section. In the embodiment shown in FIGS. 5 and 6, the taper is substantially linear. Alternative embodiments may have a non-linear taper.

Figure 8:
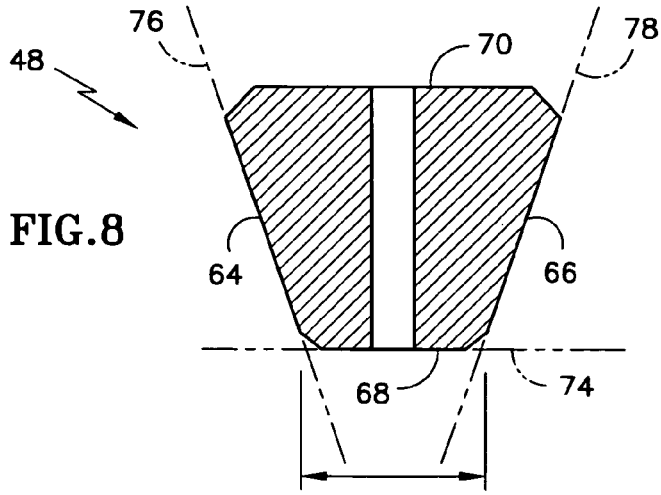
FIG. 8 is a diagrammatic cross-sectioned damper.

Referring to FIG. 8, the width of trailing edge surface 68 is defined as the shortest distance along a line 74 extending between a first plane 76 in which the first contact surface 64 is substantially disposed, and a second plane 78 in which the second contact surface 66 is substantially disposed. The line 74 is in contact with the trailing edge surface 68. The sectioned damper diagrammatically shown in FIG. 8 has a symmetrical trapezoidal type cross-sectional shape. The line 74 extends between the lines representing the first and second planes 76, 78. The angles between the line 74 and each plane 76, 78 are substantially equal. The width of the leading edge surface 70 may be defined similarly, with the exception that the line 74 would be contact with the leading edge surface 70.

Referring to FIGS. 5 and 6, one or more cooling apertures 82 are disposed in the body 58 adjacent the base 60. The cooling apertures 82 have a diameter that is substantially equal to or greater than the width of the trailing edge surface 68 adjacent the tip 62. In some embodiments, the cooling apertures 82 are uniform in diameter. In other embodiments, there is a plurality of different diameter cooling apertures 82. The cooling apertures 82 extend between the leading edge surface 70 and the trailing edge surface 68, thereby enabling passage of cooling air through the damper 48 between the contact surfaces 64, 66.

Figure 7:
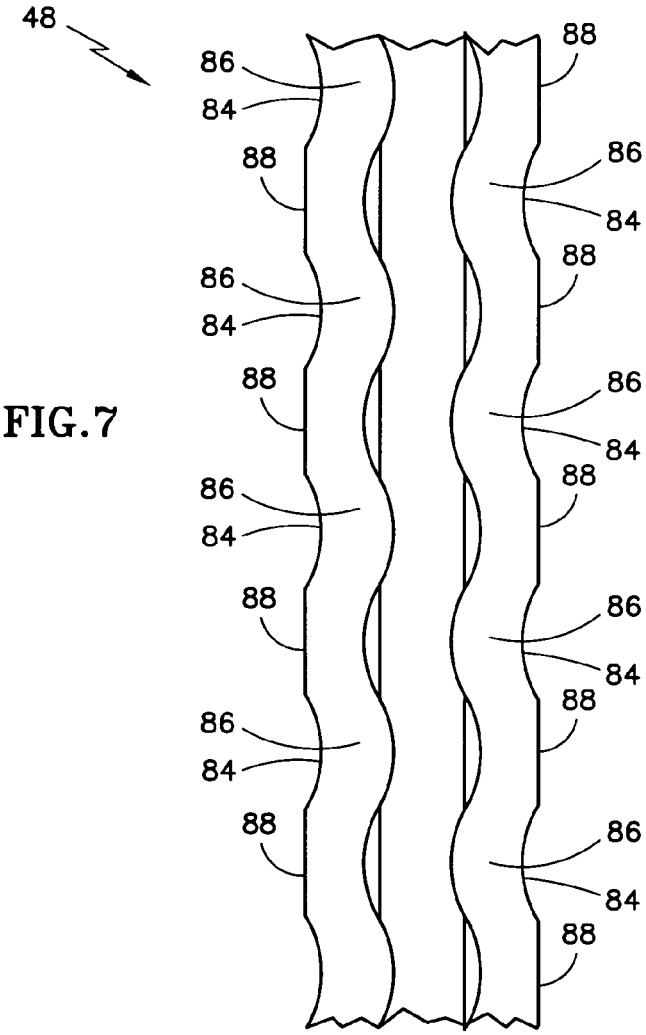
FIG. 7 is a diagrammatic planar view of a damper having wavy contact surfaces.

In some embodiments, the damper 48 further includes a plurality of cooling channels 84 disposed in each contact surface 64, 66 adjacent the tip 62 of the damper 48. The cooling channels 84 extend in a direction approximately perpendicular to the lengthwise centerline 80 of the damper 48. FIG. 6 shows the cooling channels 84 disposed within the first contact plane 64 offset from the cooling channels 84 disposed within the second contact plane 66 along the lengthwise centerline 80. The cooling channels 84 within the first and second contact planes 64, 66 are not necessarily offset, however. In FIGS. 5 and 6, the cooling channels 84 are substantially rectangular in cross-section. The cooling channels 84 are not limited to a rectangular cross-sectional shape. For example, the cooling channels 84 can be formed by a wavy contact surface (see FIG. 7), wherein the valleys 86 form the channels 84 and the peaks 88 form the portion of the contact surface 64, 66 operable to be in contact with the blade 14. The cooling channels 84 may also be formed by protrusions extending out from the contact surfaces 64, 66, wherein the channels 84 extend between the protrusions.

In some embodiments, the damper 48 further includes a head 90, fixed to one end of the body 58. U.S. Pat. Nos. 5,820,343 and 5,558,497 disclose examples of dampers 48 having a head 90 attached to the body 58 of the damper 48. U.S. patent application Ser. No. 10/771,587 discloses an alternative damper head embodiment. U.S. Pat. Nos. 5,820, 343 and 5,558,497, and U.S. patent application Ser. No. 10/771,587 are hereby incorporated by reference. These head embodiments are examples of damper heads 90 that may be used with the present invention damper 48. The present damper 48 is not, however, limited to these damper head embodiments.

Referring to FIGS. 1 and 2, under steady-state operating conditions, a rotor assembly 10 within a gas turbine engine rotates through core gas flow passing through the engine. The high temperature core gas flow impinges on the blades 14 of the rotor assembly 10 and transfers a considerable amount of thermal energy to each blade 14, usually in a non-uniform manner. To dissipate some of the thermal energy, cooling air is passed into the conduits 30 within the root 20 of each blade 14. From there, a portion of the cooling air passes into the first cavity 40 and into contact with the damper 48. The cooling apertures 82 in the damper 48 provide a path through which cooling air may pass into the second cavity 42. In those embodiments that include cooling channels 48, the cooling channels 48 also provide a path through which cooling air may pass into the second cavity 42.

Referring to FIGS. 2–4, the contact surfaces 64, 66 of the damper 48 contact the walls 50 of the passage 44. Centrifugal forces acting on the damper 48, created as the disk 12 of the rotor assembly 10 is rotated about its rotational centerline 18, provide a portion of the force that loads the damper 48 into contact with the blade 14. In the embodiment shown in FIG. 2, the skew of the passage 44 relative to the radial centerline 28 of the blade 14, and the damper 48 received within the passage 44, causes a component of the centrifugal force acting on the damper 48 to act in the direction of the blade walls 50; i.e., the centrifugal force component acts as a normal force against the damper 48 in the direction of the blade walls 50.

Although this invention has been shown and described with respect to the detailed embodiments thereof, it will be understood by those skilled in the art that various changes in form and detail thereof may be made without departing from the spirit and the scope of the invention. For example, it is disclosed as the best mode for carrying out the invention that a damper 48 is disposed between a first and second cavity 40, 42 where the second cavity 42 is adjacent the trailing edge 38 of the airfoil 22. In alternative embodiments, a damper 48 may be disposed between any two cavities within the airfoil 22.

What is claimed is:

1. A rotor blade damper, comprising:

a body having a base, a tip, a first contact surface, a second contact surface, a trailing edge surface, a leading edge surface, wherein the trailing edge and the leading edge surfaces extend between the contact surfaces, and the surfaces extend lengthwise between the base end the tip, and the body includes at least one cooling aperture disposed adjacent the base, that has a diameter that is substantially equal to or greater than the width of the trailing edge surface adjacent the tip; and wherein the body tapers between the base and the tip such that a first widthwise cross-sectional area adjacent the base is greater than a second widthwise cross-sectional area adjacent the tip and includes a lengthwise axis, and wherein the body tapers such that at substantially every point along the lengthwise axis the leading edge surface is greater than the trailing edge surface at that point and said rotor blade damper further comprising one or more cooling channels disposed in the first contact surface adjacent the tip.

2. The rotor blade damper of claim 1, further comprising one or more cooling channels disposed in the second contact surface adjacent the tip.

3. The rotor blade damper of claim 2, wherein the cooling channels are substantially rectangular in cross-section.

4. The rotor blade damper of claim 2, wherein the first contact surface and the second contact surface are wavy, and the cooling channels are valley portions of each contact surface.

5. The rotor blade damper of claim 2, wherein the cooling channels in the first contact surface are offset from the cooling channels in the second contact surface.

6. The rotor blade damper of claim 1, comprising a plurality of cooling apertures.

7. The rotor blade damper of claim 6, wherein a portion of the plurality of cooling apertures have a first diameter, and a portion of the plurality of cooling apertures have a second diameter, and the first diameter is greater than the second diameter.

8. A rotor blade for a rotor assembly, comprising:

a root;

an airfoil that includes a base, a tip, a first cavity, a second cavity, and a passage disposed between the first cavity and the second cavity, thereby connecting the first arid second cavities;

a damper received within the passage, having a body having a base, a tip, a first contact surface, a second contact surface,a trailing edge surface, a leading edge surface, wherein the trailing edge and the leading edge surfaces extend between the contact surfaces, and the surfaces extend lengthwise between the base and the tip, and the body includes at least one cooling aperture disposed adjacent the base, that has a diameter that is substantially equal to or greater than the width of the trailing edge surface adjacent the tip: and wherein the body tapers between the base and the tip such that a first widthwise cross-sectional area adjacent the base is greater than a second widthwise cross-sectional area adjacent the tip and wherein the body includes a lengthwise axis, and wherein the body tapers such that at substantially every point along the lengthwise axis the leading edge surface is greater than the trailing edge surface at that point, said rotor blade further comprising one or more cooling channels disposed in the first contact surface adjacent the tip.

9. The rotor blade of claim 8, further comprising one or more cooling channels disposed in the second contact surface adjacent the tip.

10. The rotor blade of claim 9, wherein the cooling channels are substantially rectangular in cross-section.

11. The rotor blade of claim 9, wherein the first contact surface and the second contact surface are wavy, and the cooling channels are valley portions of each contact surface.

12. The rotor blade of claim 9, wherein the cooling channels in the first contact surface are offset from the cooling channels in the second contact surface.

13. The rotor blade of claim 8, comprising a plurality of cooling apertures;

14. The rotor blade of claim 13, wherein a portion of the plurality of cooling apertures have a first diameter, and a portion of the plurality of cooling apertures have a second diameter, and the first diameter is greater than the second diameter.

* * * * *